US005544396A

United States Patent [19]

Mekyska

[11] Patent Number: 5,544,396

[45] Date of Patent: Aug. 13, 1996

[54] HOLDER FOR SECURING OBJECTS

[76] Inventor: Erich Mekyska, Güterstrasse 41-43, Pforzheim, Germany

[21] Appl. No.: 317,924

[22] Filed: Oct. 17, 1994

[30] Foreign Application Priority Data

Nov. 5, 1993 [DE] Germany ..... 43 38 052.2

[51] Int. Cl.[6] ..... A44B 21/00

[52] U.S. Cl. ..... 24/523

[58] Field of Search ..... 24/523; 248/316.3, 248/316.7, 316.4

[56] References Cited

U.S. PATENT DOCUMENTS 670,446 3/1901 Fletcher et al. ..... 24/523

2,066,851 1/1937 Noyes et al. ..... 24/523 X 3,379,018 4/1968 Frentzel et al. ..... 24/523 X

*Primary Examiner*—James R. Brittain

*Attorney, Agent, or Firm*—Cohen, Pontani, Lieberman & Pavane; Christa Hildebrand

[57] ABSTRACT

A device for securing and mounting round or angular objects, which are found in households or offices, such as writing utensils, drill bits, tooth brushes, etc. The currently available fastenings, partially mentioned here, all have the disadvantage that they are only intended for a specific measurement and, therefore, offer only a secure hold for this particular size. This problem has been resolved by utilizing a single base plate 4 where at least two opposing and independently movable clamp jaws 2, 3 are under spring tension and located in a guide. Because the clamp jaws 2, 3 are under spring tension, the size of the object no longer is crucial, because when inserting the object in the retracting and contracting clamp jaws, a secure hold is accomplished.

9 Claims, 4 Drawing Sheets

HOLDER FOR SECURING OBJECTS

BACKGROUND OF THE INVENTION

1. Field of the Invention

This invention relates to a holder for securing office and household utensils as well as tools.

2. Description of Related Art

Small objects such as writing, office, household, or toiletry utensils or tools can easily be misplaced in a desk drawer or on a work surface. There are holders for specific objects, like writing utensils or toothbrushes, which consist of containers or structures that include openings for inserting the objects. However, these types of holders have the disadvantage that the openings are of a specific dimension, designed for a particular object, and deviations from these dimensions then affect the fit. Either the object doesn't fit into the opening, or it remains loose in its mountings. A further problem occurs when the object has uneven overall measurements, which results in inaccurate handling and poor support in the holder.

SUMMARY OF THE INVENTION

The object of this invention is to provide a holder for holding and securing a flat, round or square object in a designated place.

In accordance with this invention, a holder is provided which has a base plate, on which two clamp jaws are mounted and of which at least one clamp jaw is movable. At least one clamp jaw is pressed against the other clamp jaw by the tension of a spring, or two clamp jaws are pressed against each other by two springs.

The form of the object no longer matters, because the clamp jaws enable different sized object to be firmly placed between the clamp jaws. Once the object is inserted, a secure hold is insured, until the object is pulled out again.

The degree of firmness depends on the spring tension and can be selected to fit the type of objects to be held and the environment in which the holder used. Factors like gravity or vibrations can be accommodated. Thus, this invention is useful for holding objects like tools or writing objects next to or on machines or in cars, planes, etc.

One embodiment has clamp jaws, each mounted on a base plate. The inner surfaces of the clamp jaws face each other when in resting position, i.e., when no object is inserted for holding. The inner surfaces only touch each other at the lower area of the clamp jaws above the base plate. The inner surfaces of the clamp jaws are formed to accommodate the object to be held; they conform to the geometry of the object to be held, i.e., they can be rounded for round utensils, flat for flat items, triangular, etc. At least one clamp jaw is movably mounted. Each movable clamp jaw has an extension piece which is inserted into the opening on the base plate. It can be freely moved back and forth within a slotted opening in the base plate. If both clamp jaws are movable, they both can be freely moved back and forth within the slotted opening. They may be mounted on two openings, or on one longer opening accommodating both clamp jaws.

The bottom of the base plate provides a compartment for a spring. The compartment is formed by a support wall and the extension piece of the clamp jaw. If a holder is desired with two movable clamp jaws, two compartments with springs are necessary. When the clamp jaws are in rest position, i.e., when no object is being inserted between the two inner surfaces of the clamp jaws, the spring tension is minimal; when an object is being inserted for holding, the clamp jaws are pushed apart and the spring tension is maximized and the two jaws are forced toward each other, thereby holding the object securely. The moveability of the clamp or clamps in the opening may be increased by choosing an appropriate synthetic material.

In order to hold wider objects and to simplify the insertion, the base plate contains a stop located between the clamp jaws and resting on the base plate. This provides a larger opening distance between the clamps.

The base plate may have any form, e.g., round or rectangular. It may have a cover plate which can easily be snapped on to an outer support rim of the base plate. However, the base plate may also be integrated into machine or workplace surfaces. In one embodiment, the cover plate has a self-sticking surface for easy placement of the holder to any surface. Another embodiment has a magnet in the cover plate for placing it to metal surfaces.

Another embodiment provides for better spring tension. Here, an equal spring force on the clamp jaws in direction of the object to be held is accomplished by mounting the two springs on a bolt or an axis kept in place by the extensions of the clamp jaws and the support walls of the base plate. It is also possible to use only one bolt or axis for both springs. In this embodiment, the axis is supported by the support walls and the extensions of the clamp jaws.

In order to further guarantee an improved hold, the inner surfaces of the clamp jaws can be corrugated, roughened, or made of a rubber-type surface.

For further developments of this invention the design is such that the base plate can be round and can be continuously rotated, or stepwise rotated in the cover plate or a supporting body (table or machinery) on which it is fastened. Thereby, the base plate contains, on its underside, at least three holding clamps, which connect to slots on the supporting plate or supporting body. Alternatively, there is the possibility that the plate is fastened to the supporting plate via screws, clips, grooves and springs or similar fastening means.

In accordance with this invented device, the following will be described in detail in connection with the available illustrations:

DESCRIPTION OF THE PREFERRED EMBODIMENT

Figure 1:
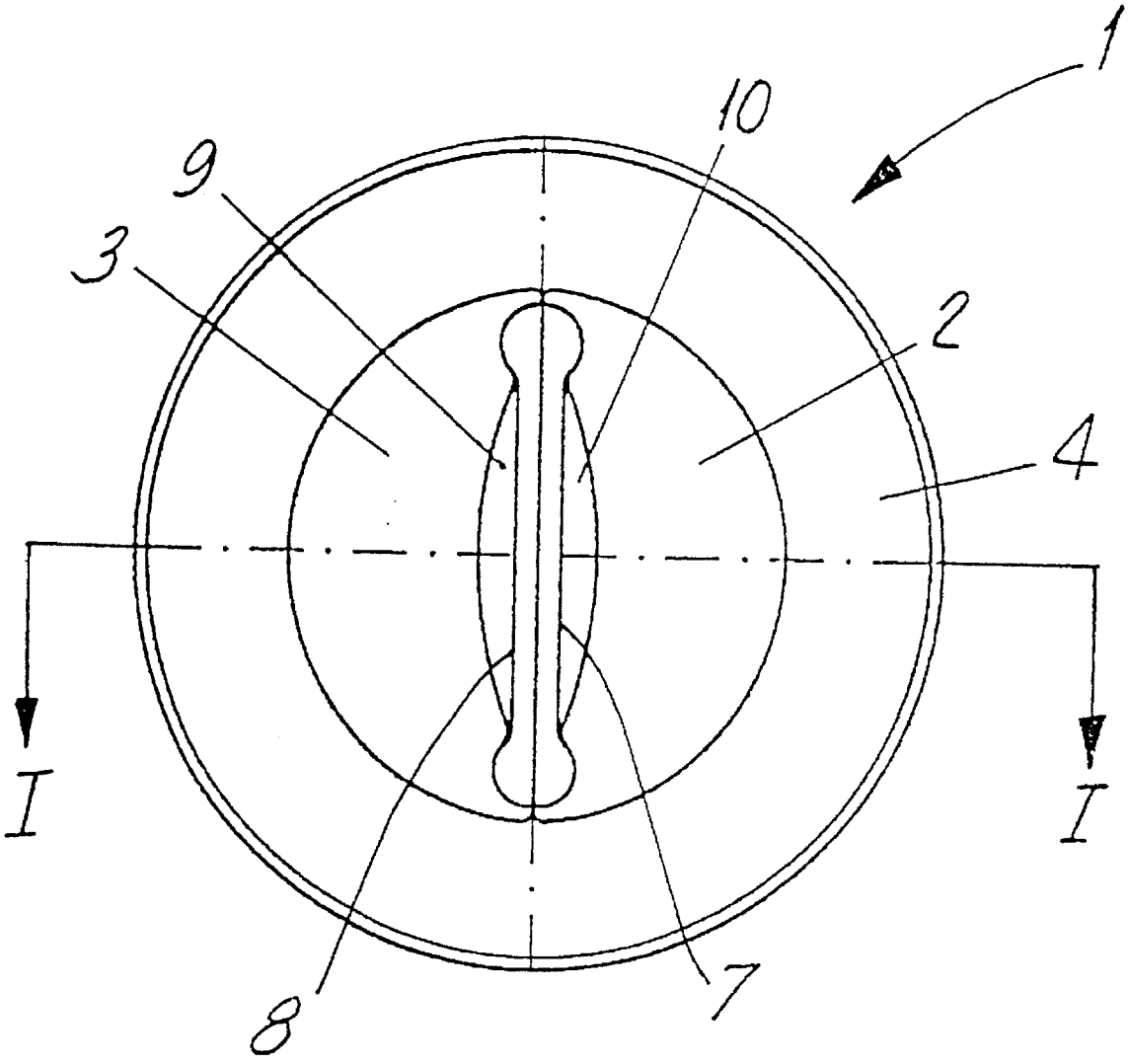
FIG. 1 Top view from the one embodiment of the holder in rest position.
Figure 2:
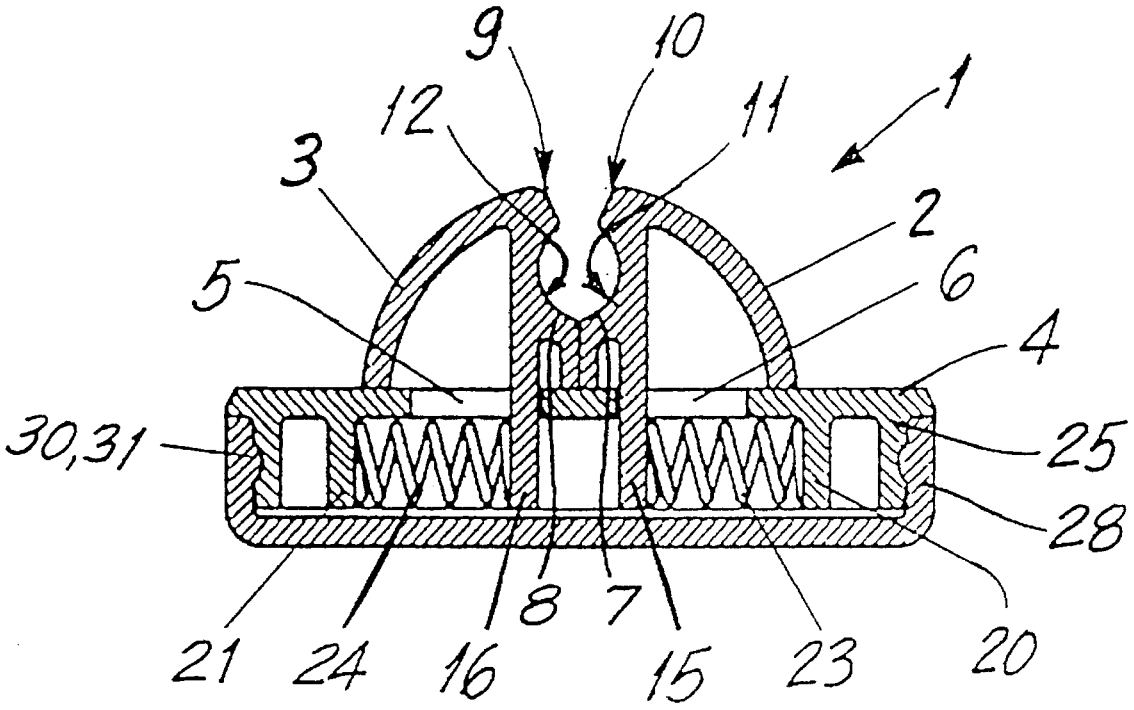
FIG. 2 Cross sectional view of the holder along lines I—I of FIG. 1.

FIG. 1 shows a top view of an embodiment of the holder 1. The clamp jaws 2 and 3 are in a rest position. FIG. 2 shows a cross-sectional view along I—I from FIG. 1. The holder 1 comprises two clamp jaws 2, 3 on a base plate 4. The clamp jaws 2, 3 are located opposite of each other and are shown each having an overall quarter spherical form. Both of the opposing inner surface areas 7, 8 of the clamp jaws 2, 3 are constructed in mirror image to one another and are shaped to allow easy insertion of an object to be held (not shown). For that reason, the top areas of the clamps have slopes 9, 10. The inner surface areas of the clamps are rounded in the middle sections 11, 12. In the embodiment of FIG. 2, the rounding 11, 12 runs horizontal to the base plate. However, it is also conceivable to have a vertical or sloped alignment. The choice between the shape of opening depends on the object to be held.

When the clamp jaws 2, 3 are in rest position, as shown in FIG. 1 and 2, only the inner surface areas 7, 8 of the clamp jaws 2, 3 touch each other in the lower area near the base plate 4, so that both slopes 9, 10 do not touch each other which simplifies the inserting the object which is clamped in the middle area 11, 12 of the inner surface area 7, 8. Even though the rounded inner surface of the clamp jaws are very useful, there is also the possibility to select an other-shaped cross section of the clamp jaws 2, 3, i.e., a triangle or a bullet shape.

The clamp jaws 2, 3 have extensions 15, 16, which extend through the openings 5, 6 of the base plate. It is also possible to have only one opening. The underside of the base plate 4 has two support walls 20, 21 which form one compartment wall for the springs 23, 24, the other compartment wall is formed by the extensions 15, 16 of the clamp jaws. On the outside of the base plate may be a rim 25. The base plate with the support walls and the rim are generally made of one piece. The base plate is sealed on its underside with a cover plate 28, which is held to the rim 25 by a snap 30 in a groove 31. The cover plate prevents dirt from entering the spring area which guarantees better functioning.

As can easily be seen, the two springs 23, 24 press both clamp jaws 2, 3 together when in rest position. When an object is held between the clamp jaws 2, 3 the clamp jaws are pushed apart against the tension of both springs 23, 24, and the object is held firmly by the tension force of both springs 23, 24.

Figure 3:
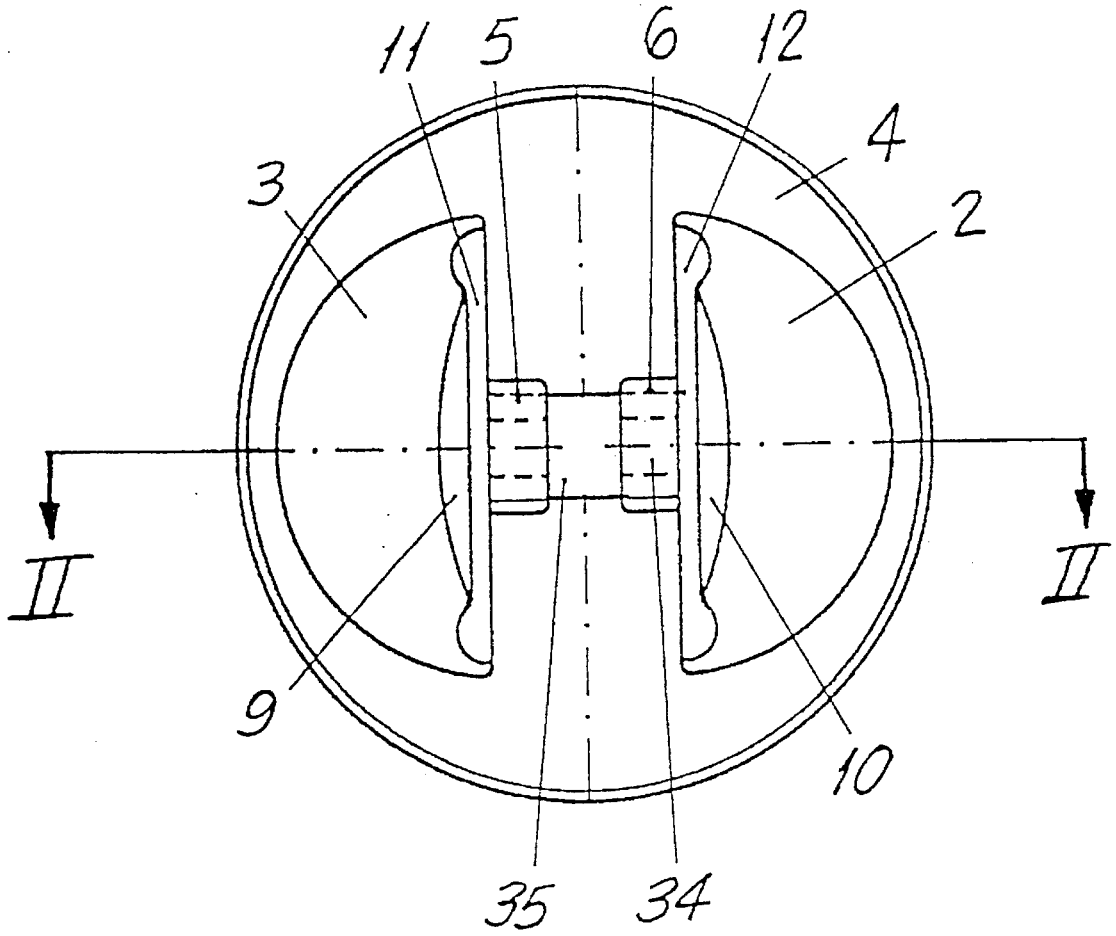
FIG. 3 Top view of another embodiment of the holder, in expanded position.

FIG. 3 shows a top view of an embodiment in an expanded position, with an optional stop 35 between the clamp jaws.

Figure 4:
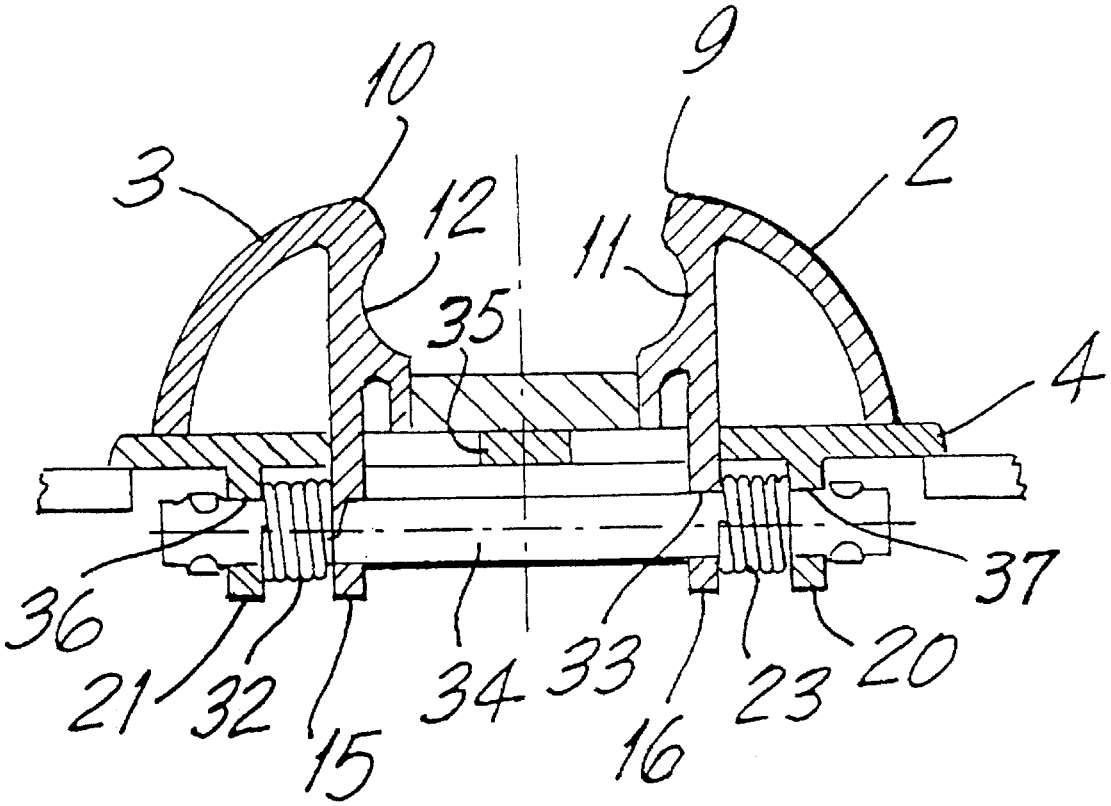
FIG. 4 Cross sectional view of the embodiment in FIG. 3 along lines II—II, in expanded position.

FIG. 4 shows a cross-sectional view along lines II—II of this embodiment shown in FIG. 3. This embodiment is shown with a different spring arrangement. The extensions 15, 16 of the clamp jaws 2, 3 are fitted into the openings 5, 6. However, in this embodiment, the extensions have bores 32, 33 through which an axis or bolt 34 fits. The bolt is secured by two holding means 36, 37 next to support walls 20, 21. The axis or bolt 34 supports two springs 23, 24, each spring located between the support walls 20, 21 and the extensions 15, 16. When the clamp jaws are in rest position, the spring force maintains the rest position. When the jaws are expanded, i.e., when an object to be held is inserted into the jaws, the spring force presses against the extensions, which presses the clamp jaws together. A stop 35 may be provided for the opening when larger objects are to be held.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed:

1. A device for clamping objects of a plurality of dimensions, comprising:

a base plate including a top side defining at least one opening and first and second support walls each having a recess extending therethrough;

first and second clamp jaws, each of said first and second clamp jaws including an inner surface area and an extending end having a recess extending therethrough, said extending end of both said first and second clamp jaws positioned to extend through the at least one opening in the base, a bolt extending through the recess in said first and second support walls and the recess in said first and second clamp jaws for mounting said first and second clamp jaws to said base plate, said first clamp jaw being movable along said bolt; and a first spring positioned about said bolt and connected between said first clamp jaw and said first support wall for exerting a moving force on said extending end of said first clamp jaw towards said second clamp jaw, said device movable between a first unclamped position in which said inner surface area of said first and second clamp jaws are at least partially in contact and said first spring is in a first extended position and a second clamped position in which an object is clamped between said inner surface area of said first and second clamp jaws, said first and second clamp jaws being separated by a distance equal to a width of the object slid therebetween and said first spring is in a second tensioned position.

2. The device of claim 1, wherein said bolt movably mounts said second clamp jaw to said second support wall and said device further comprises a second spring positioned about said bolt and connected between said second clamp jaw and said second support wall for exerting a moving force on said second clamp jaw towards said first clamp jaw, said second spring being in first extended position when said device is in said first unclamped position and in a second tensioned position when said device is in said second clamped position.

3. The device of claim 2, wherein said base plate includes first and second compartments, said first and second springs being positioned within said first and second compartments, respectively.

4. The device of claim 3, wherein said first and second compartments are defined by said first and second support walls and said extending end of said first and second clamp jaws, respectively.

5. The device of claim 2, wherein said base plate further includes a stop means for limiting the movement of said first and second clamp jaw positioned in the center of the at least one opening.

6. The device of claim 1, wherein the at least one opening is symmetrically arranged in a center area of said top side.

7. The device of claim 1, wherein said inner surface areas are shaped in accordance with the object to be clamped.

8. The device of claim 1, wherein said first and second clamp jaws each include a top sloped side for providing easy insertion of the object.

9. The device of claim 1, wherein said inner surface area of said first and second clamp jaws are each made of one of a corrugated, roughened and rubber substance.

* * * * *